US012593917B2

(12) United States Patent
Lu

(10) Patent No.: US 12,593,917 B2
(45) Date of Patent: Apr. 7, 2026

(54) FOLDING RECLINER WITH GUIDE MECHANISMS

(71) Applicant: ZHEJIANG ZHENDONG LEISURE PRODUCTS CO., LTD, Zhejiang (CN)

(72) Inventor: Xiudong Lu, Zhejiang (CN)

(73) Assignee: ZHEJIANG ZHENDONG LEISURE PRODUCTS CO., LTD, Zhejiang (CN)

( * ) Notice: Subject to any disclaimer, the term of this patent is extended or adjusted under 35 U.S.C. 154(b) by 210 days.

(21) Appl. No.: 18/632,179

(22) Filed: Apr. 10, 2024

(65) Prior Publication Data

US 2025/0000261 A1 Jan. 2, 2025

Related U.S. Application Data

(63) Continuation-in-part of application No. 18/488,054, filed on Oct. 17, 2023.

(30) Foreign Application Priority Data

Jun. 28, 2023 (CN) ..... 202321653029.0
Dec. 29, 2023 (CN) ..... 202323644212.7

(51) Int. Cl.
*A47C 1/14* (2006.01)
*A47C 1/035* (2006.01)
(Continued)

(52) U.S. Cl.
CPC ..... *A47C 1/0352* (2013.01); *A47C 1/0355* (2013.01); *A47C 1/14* (2013.01);
(Continued)

(58) Field of Classification Search
CPC .. A47C 1/14; A47C 1/143; A47C 4/28; A47C 7/5068
See application file for complete search history.

(56) References Cited

U.S. PATENT DOCUMENTS 597,480 A 1/1898 Fellows
655,593 A 8/1900 Webb
(Continued)

FOREIGN PATENT DOCUMENTS

CN 215076900 12/2021

OTHER PUBLICATIONS

"Office Action of U.S. Counterpart Application", issued on Jul. 29, 2025, p. 1-p. 12.

*Primary Examiner* — Rodney B White
(74) *Attorney, Agent, or Firm* — JCIPRNET

(57) ABSTRACT

Disclosed is a folding recliner with guide mechanisms, including a backrest portion, a seat portion and a footrest portion, where a supporting leg is arranged at the back of the backrest portion; retraction and supporting rods are fitted with the supporting leg, the other end of each of the retraction and supporting rods is configured to be hinged and fitted with a linkage rod, and the other end of the linkage rod is mounted on the seat portion in a fitted manner; and each of the guide mechanisms includes a guide rod and a guide member, one end of the guide rod is configured to be hinged and fitted with the backrest portion, the other end of the guide rod is a free end, a guide sliding groove is formed in the guide rod, the guide member is capable of moving along the guide sliding groove.

10 Claims, 11 Drawing Sheets

(51) Int. Cl.

| | |
|---|---|
| ***A47C 1/0355*** | (2013.01) |
| ***A47C 4/00*** | (2006.01) |
| ***A47C 4/28*** | (2006.01) |
| ***A47C 7/50*** | (2006.01) |

(52) U.S. Cl.
CPC ..... *A47C 1/143* (2013.01); *A47C 4/00* (2013.01); *A47C 4/28* (2013.01); *A47C 7/5068* (2018.08)

(56) References Cited

U.S. PATENT DOCUMENTS

| | | | | |
|---|---|---|---|---|
| 663,486 | A | 12/1900 | Boren | |
| 2,216,317 | A | 10/1940 | Karish | |
| 5,423,592 | A | 6/1995 | Spurrier et al. | |
| 6,113,181 | A | 9/2000 | Tang | |
| 10,722,039 | B2 | 7/2020 | Weldon et al. | |
| 2018/0344032 | A1 | 12/2018 | Eskridge, III et al. | |
| 2022/0202187 | A1 | 6/2022 | Rangel | |
| 2025/0000263 | A1* | 1/2025 | Lu ..... | A47C 1/0342 |

* cited by examiner

FOLDING RECLINER WITH GUIDE MECHANISMS

CROSS-REFERENCE TO RELATED APPLICATION

This is a continuation-in-part application of U.S. application Ser. No. 18/488,054, filed on Oct. 17, 2023, which claims the priority benefits of China application serial no. 202321653029.0, filed on Jun. 28, 2023. This application claims the priority benefit of China application serial no. 202323644212.7, filed on Dec. 29, 2023. The entirety of each of the above-mentioned patent applications is hereby incorporated by reference herein and made a part of this specification.

BACKGROUND

Technical Field

The present disclosure relates to the technical field of folding chairs, in particular to a folding recliner with guide mechanisms.

Description of Related Art

There are various folding chairs now available, most of which are applied indoors, and the folding chairs have the main advantages of capabilities of greatly reducing the occupied space and facilitating storage. The existing folding chairs are mainly composed of supports, surface frames and fabrics, can be used by users for resting after being unfolded, and can be used by the users for sitting as well as lying. The existing folding chairs can provide the greater lying sizes, but cannot achieve the flat-lying effect. Thus, as shown in the publication number CN215076900U, a folding flat deck chair is disclosed, said chair including a chair surface frame, chair legs and a chair back, where the chair surface frame is hinged to the chair back, and the chair surface frame is connected to the chair legs; a first hinge block is connected between the chair surface frame and the chair back, and a fixing device is connected to the middle of the first hinge block and used for fixing the positions of the chair surface frame and the chair back.

However, the above product was developed by the applicant in the early stage. With the wide application of the product on the market, user feedback from many customers has been received now, and the core technical defects are as follows: during the use process of said chair, when the user needs to perform a lying operation, the user may forget to open a supporting frame and directly lies said chair flat for use, which leads to the problem of backward falling of the user easily and causes certain potential safety hazards.

SUMMARY

In order to solve the above problems, the present disclosure aims to provide a folding recliner with guide mechanisms, the guide mechanisms are optimized and added, such that a supporting leg can form guide supporting after the folding recliner is laid flat, and the supporting and unfolding stability and reliability of the supporting leg can be improved.

The technical problems can be solved by the present disclosure through the following technical solution:

the folding recliner with guide mechanisms comprises a backrest portion, a seat portion and a footrest portion, where a supporting leg is arranged at the back of the backrest portion; retraction and supporting rods are fitted with the supporting leg, the other end of each of the retraction and supporting rods is configured to be hinged and fitted with a linkage rod, and the other end of the linkage rod is mounted on the seat portion in a fitted manner; guide mechanisms are further comprised; each of the guide mechanisms comprises a guide rod and a guide member, one end of the guide rod is configured to be hinged and fitted with the backrest portion, the other end of the guide rod is a free end, a guide sliding groove is formed in the guide rod, the guide member is capable of moving along the guide sliding groove, and one end of the guide member is mounted on the supporting leg in a fitted manner; when the backrest portion is changed from a vertical state to a lying state, the supporting leg is supported by the retraction and supporting rods, the supporting leg moves along the guide sliding grooves by means of the guide members, and an angle between the supporting leg and the backrest portion is gradually increased; and when the backrest portion is changed from the lying state to the vertical state, the supporting leg is pulled by the retraction and supporting rods, the supporting leg moves along the guide sliding grooves by means of the guide members, and the angle between the supporting leg and the backrest portion is gradually reduced.

A hinged position of the supporting leg with the backrest portion is located above hinged positions of the guide rods with the backrest portion.

Hinged positions of the retraction and supporting rods with the supporting leg are located above mounting positions of the guide members on the supporting leg.

Each of the guide members comprises a guide shaft body, one end of the guide shaft body is fixedly mounted on the supporting leg, the other end of the guide shaft body extends outwards and penetrates through the respective guide sliding groove, and the guide shaft body is capable of reciprocating along the guide sliding groove under the drive of the supporting leg.

Each of the guide sliding grooves has a starting end and a tail end, when the respective guide shaft body is located at the starting end, the backrest portion is in the vertical state, and the supporting leg is vertically suspended and hung at the back of the backrest portion; and when the guide shaft body moves to the tail end under the drive of the supporting leg, the backrest portion is in the lying state, and a bottom end of the supporting leg abuts against the ground.

Each of the guide rods comprises a bent rod portion and a straight rod portion, the respective guide sliding groove is located on the straight rod portion, a guide rod abutting hole is formed in an end portion of the bent rod portion, guide rod hinge holes are formed in the backrest portion, and the guide rod abutting hole and the respective guide rod hinge hole are mounted in a fitted manner by means of a third hinge shaft.

Each of the guide sliding grooves is a long hole groove.

A guide wheel is arranged on each of the guide shaft bodies, and the guide wheel is configured to be in sliding fit along the respective guide sliding groove.

Hinge lifting lugs are arranged at upper ends of the supporting leg, supporting abutting holes are formed in the hinge lifting lugs, supporting hinge holes are formed in the backrest portion, and the supporting abutting holes and the supporting hinge holes are mounted in a fitted manner by means of first hinge shafts.

Retraction and supporting hinge holes are formed in the supporting leg, retraction and supporting abutting holes are formed in end portions of the retraction and supporting rods, and the retraction and supporting abutting holes and the retraction and supporting hinge holes are mounted in a fitted manner by means of second hinge shafts.

Compared with the prior art, the present disclosure has the beneficial effects as follows: according to the present disclosure, the guide mechanisms are optimized and added, such that the supporting leg can form guide supporting after the folding recliner is laid flat, and the supporting and unfolding stability and reliability of the supporting leg can be improved; moreover, under the drive of the retraction and supporting rods, and in combination with guide movements of the guide mechanisms, the automatic landing support of the supporting leg can be enhanced, and the use convenience and safety can be improved.

The features of the present disclosure can be clearly understood by referring to drawings of this case and detailed description of the following preferred embodiment.

DESCRIPTION OF THE EMBODIMENTS

In order to make the technical means, creative features, purposes and effects of the present disclosure easy to understand, the present disclosure is further illustrated below in combination with the specific drawings.

Figure 1:
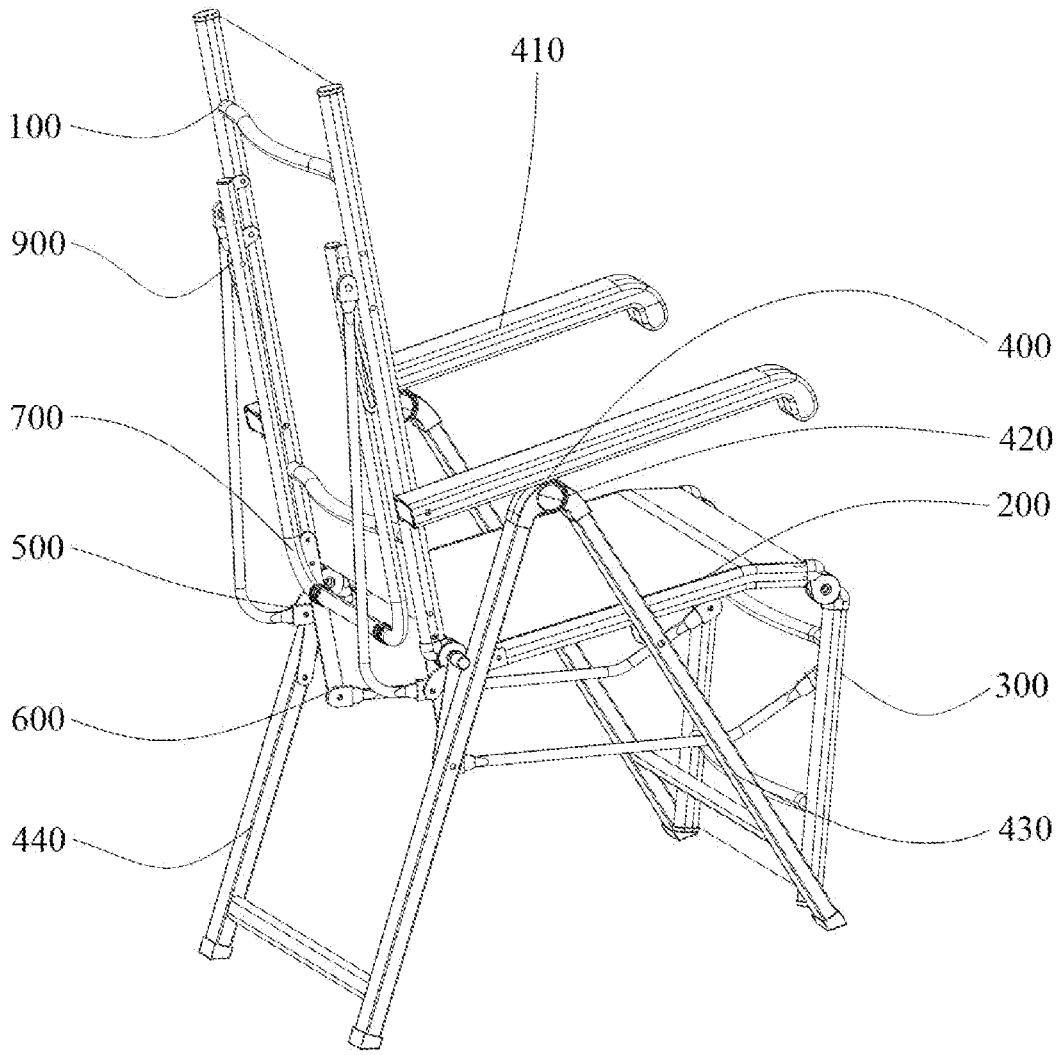
FIG. 1 is a first overall structure diagram of the present disclosure.
Figure 2:
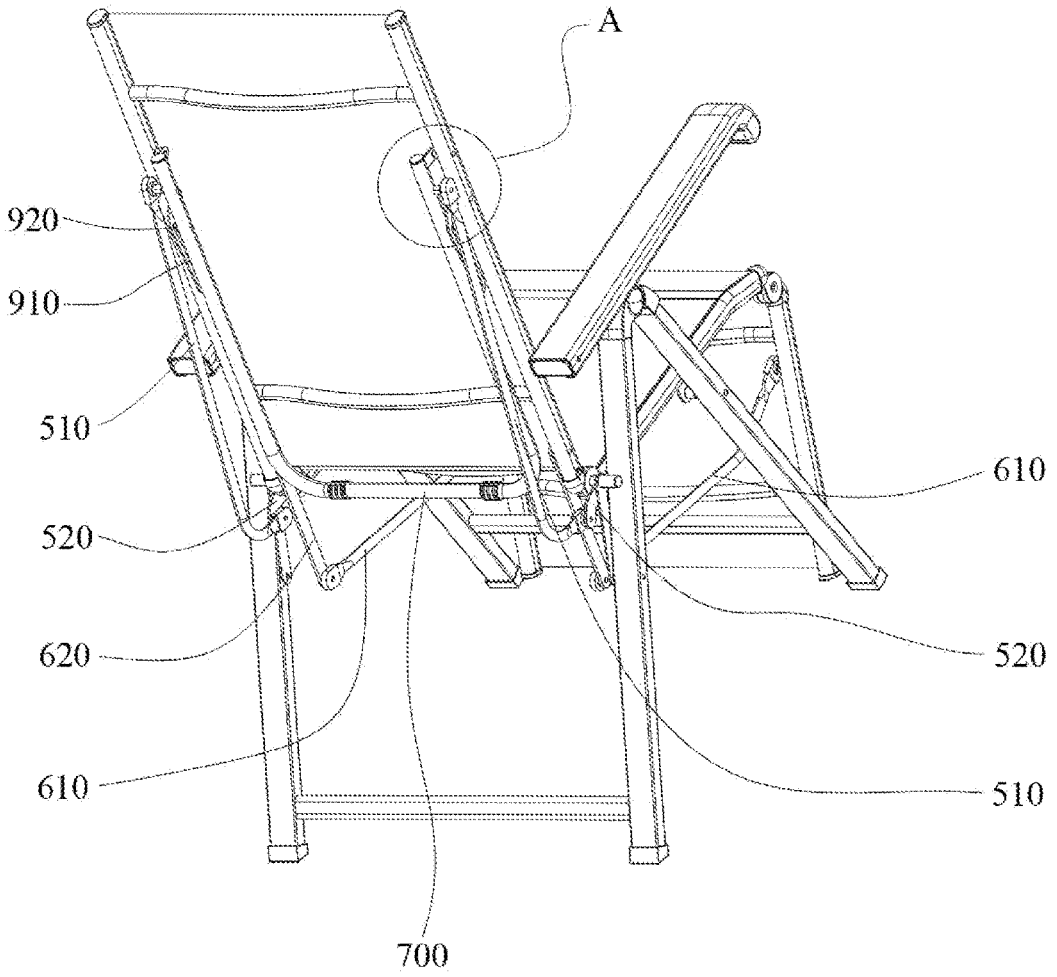
FIG. 2 is a second overall structure diagram of the present disclosure.
Figure 3:
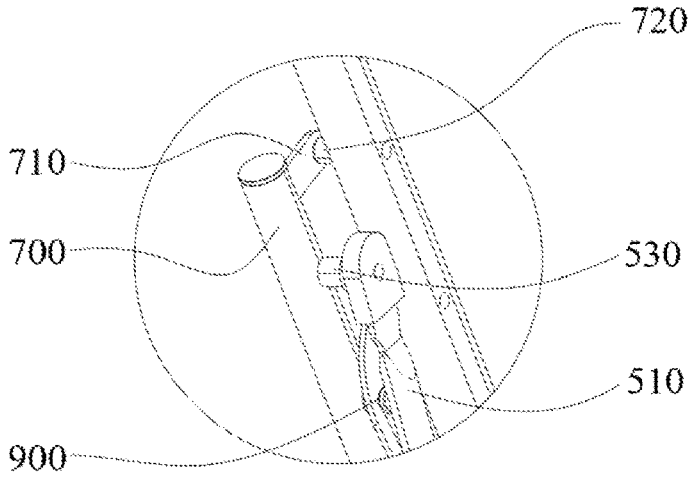
FIG. 3 is a partial enlarged structure diagram at part A in FIG. 2.
Figure 4:
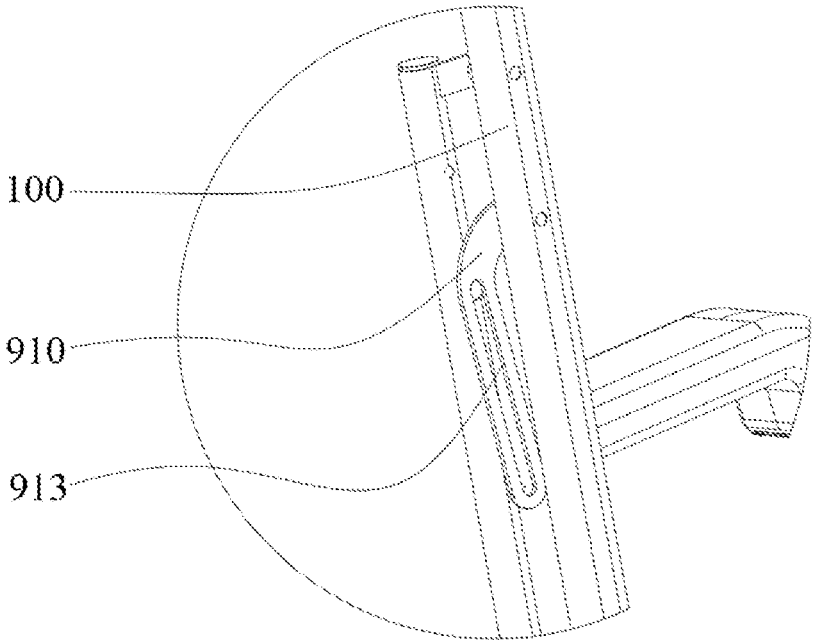
FIG. 4 is a mounting structure diagram of a guide rod and a backrest portion of the present disclosure.
Figure 5:
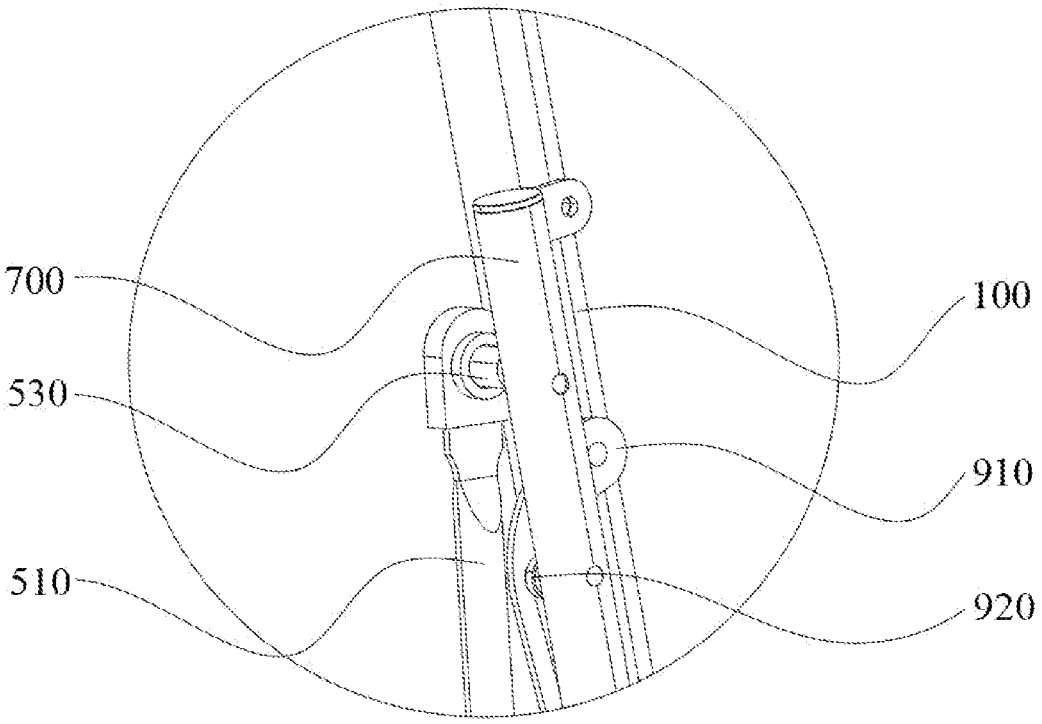
FIG. 5 is a mounting structure diagram of a guide mechanism of the present disclosure.
Figure 6:
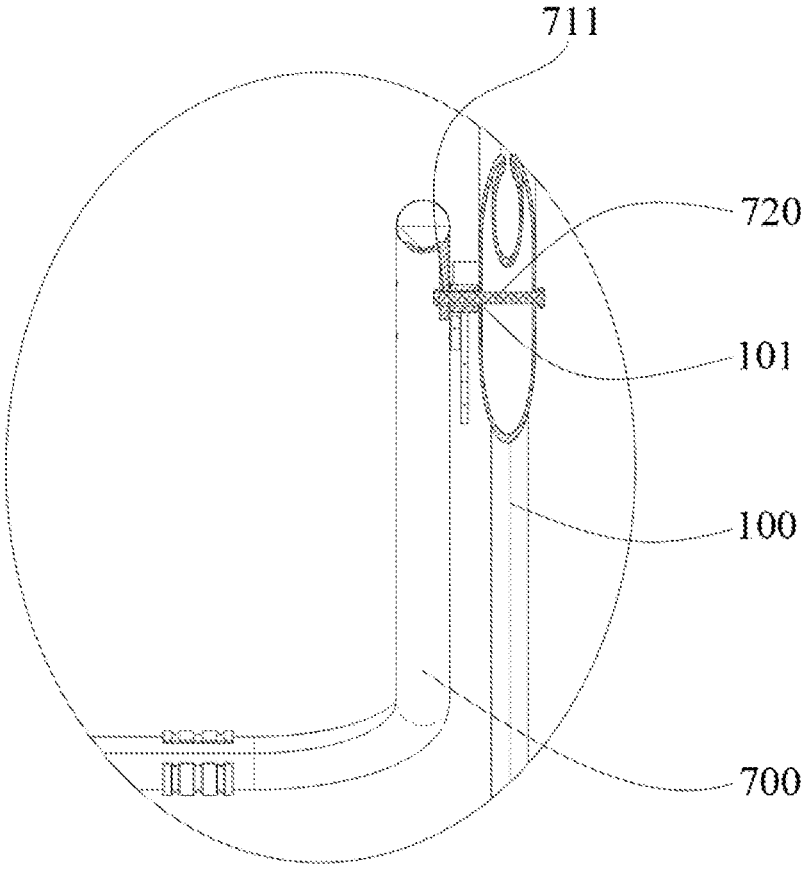
FIG. 6 is a sectional mounting structure diagram of a supporting leg and the backrest portion of the present disclosure.
Figure 7:
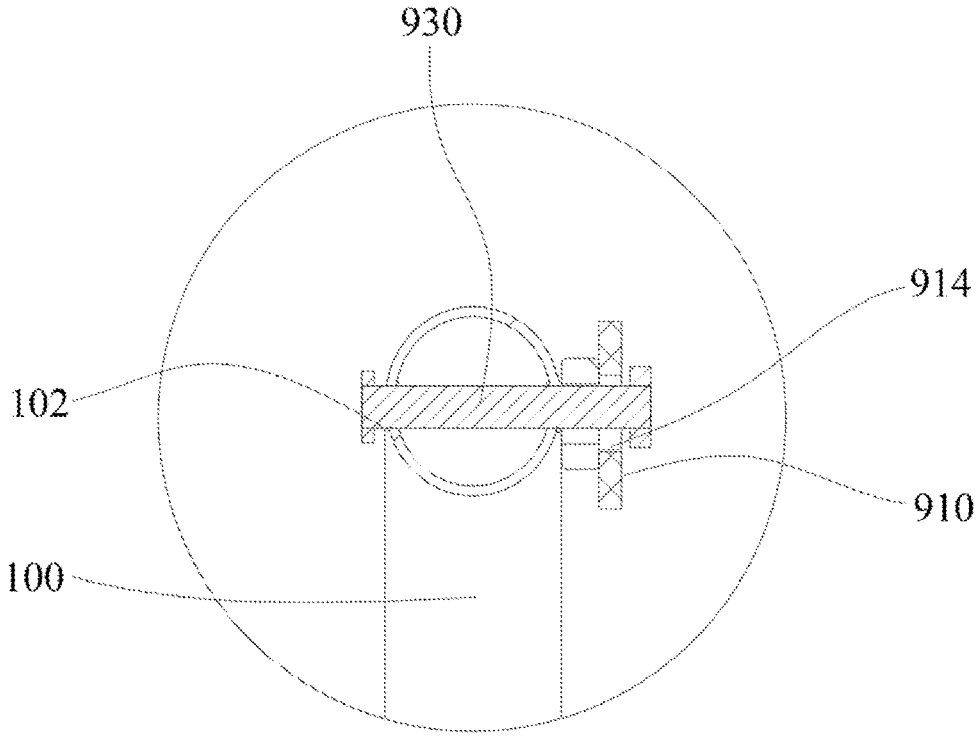
FIG. 7 is a sectional mounting structure diagram of the guide rod and the backrest portion of the present disclosure.
Figure 8:
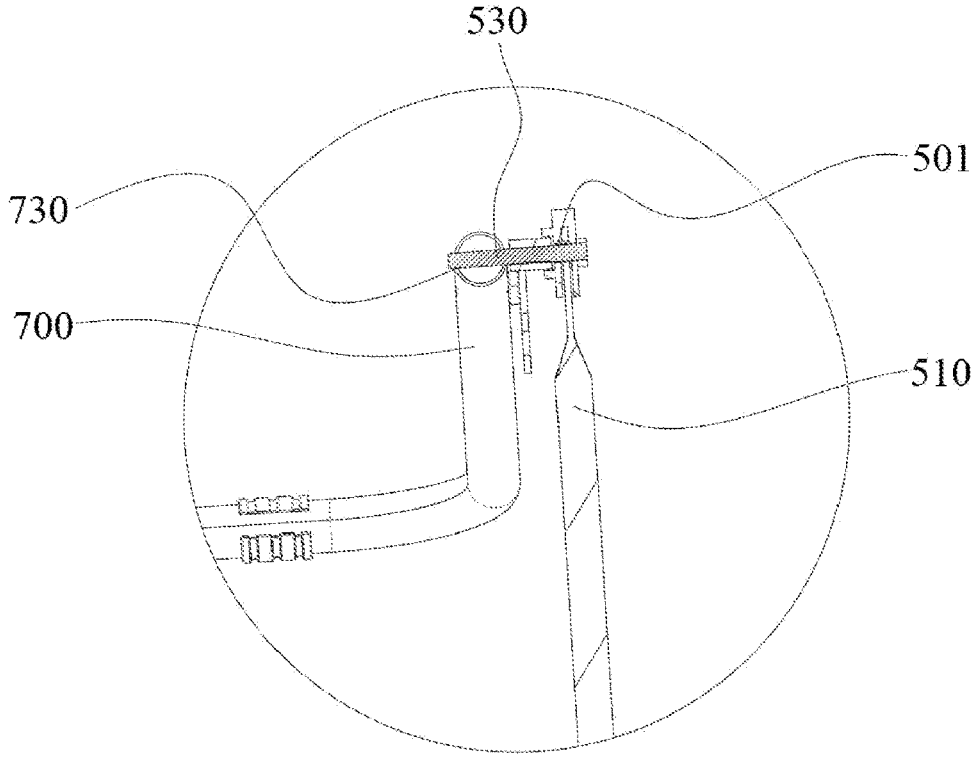
FIG. 8 is a sectional mounting structure diagram of the supporting leg and a retraction and supporting rod of the present disclosure.
Figure 9:
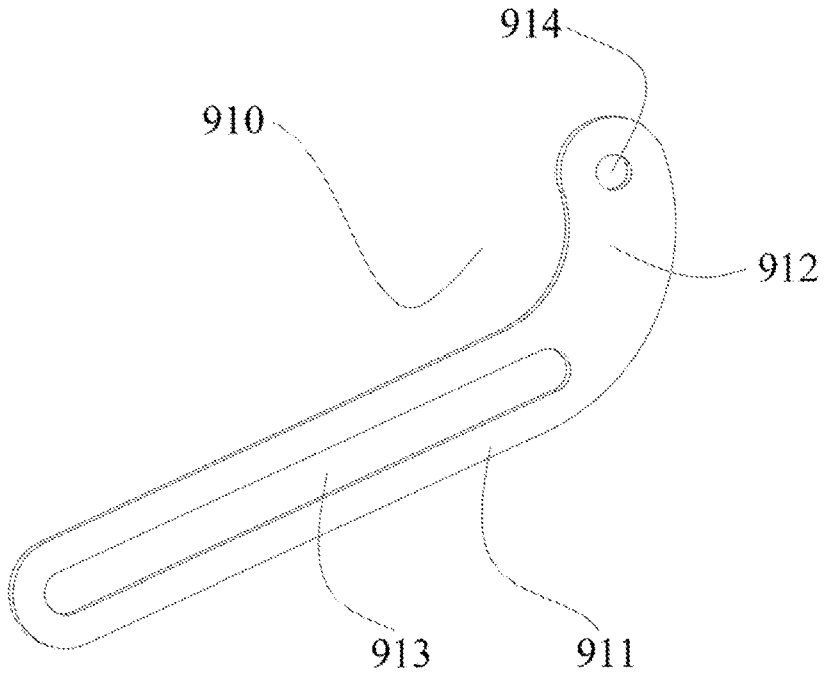
FIG. 9 is a structure diagram of the guide rod of the present disclosure.
Figure 10:
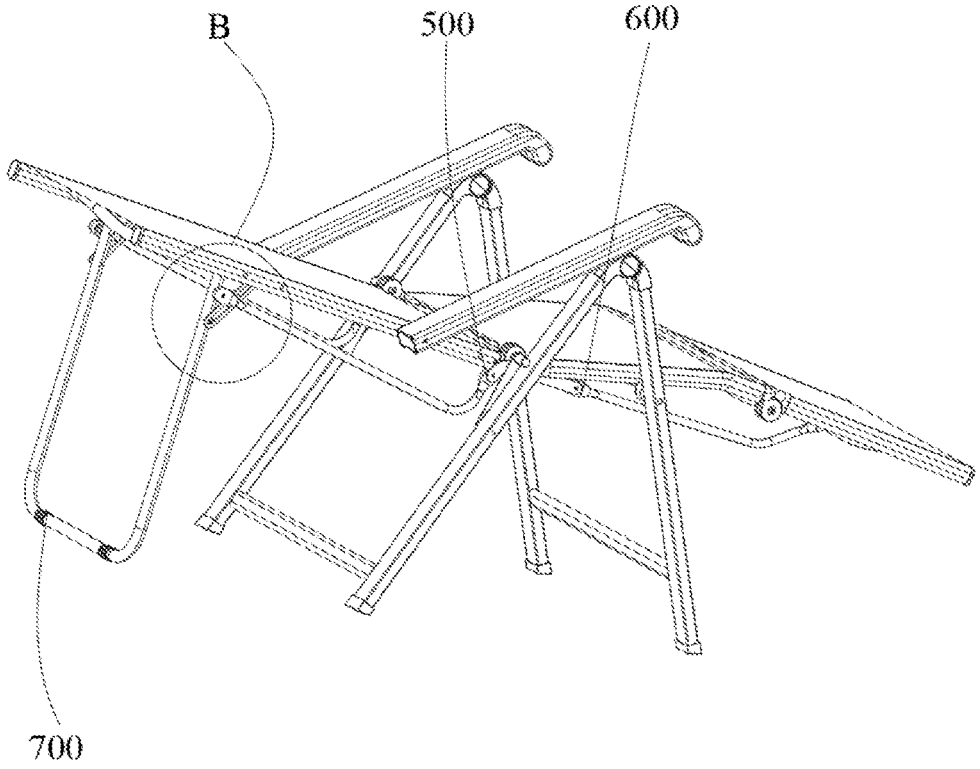
FIG. 10 is a first overall structure diagram of the present disclosure in a lying state.
Figure 11:
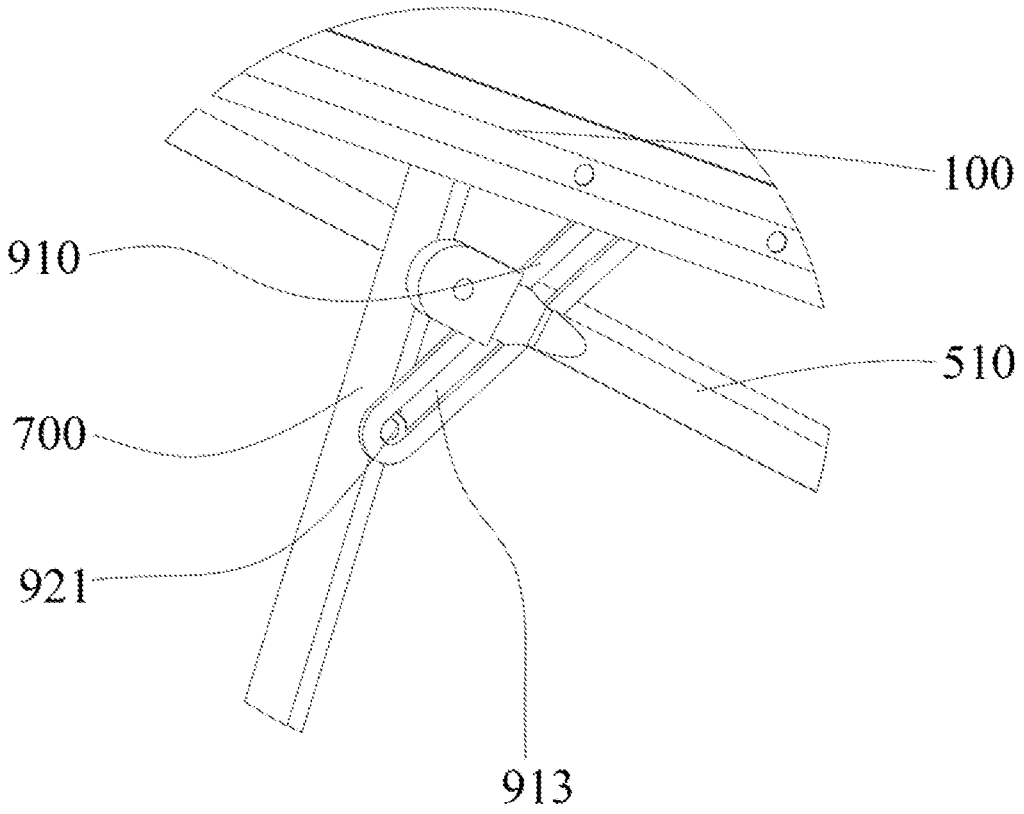
FIG. 11 is a partial enlarged structure diagram at part B in FIG. 10.
Figure 12:
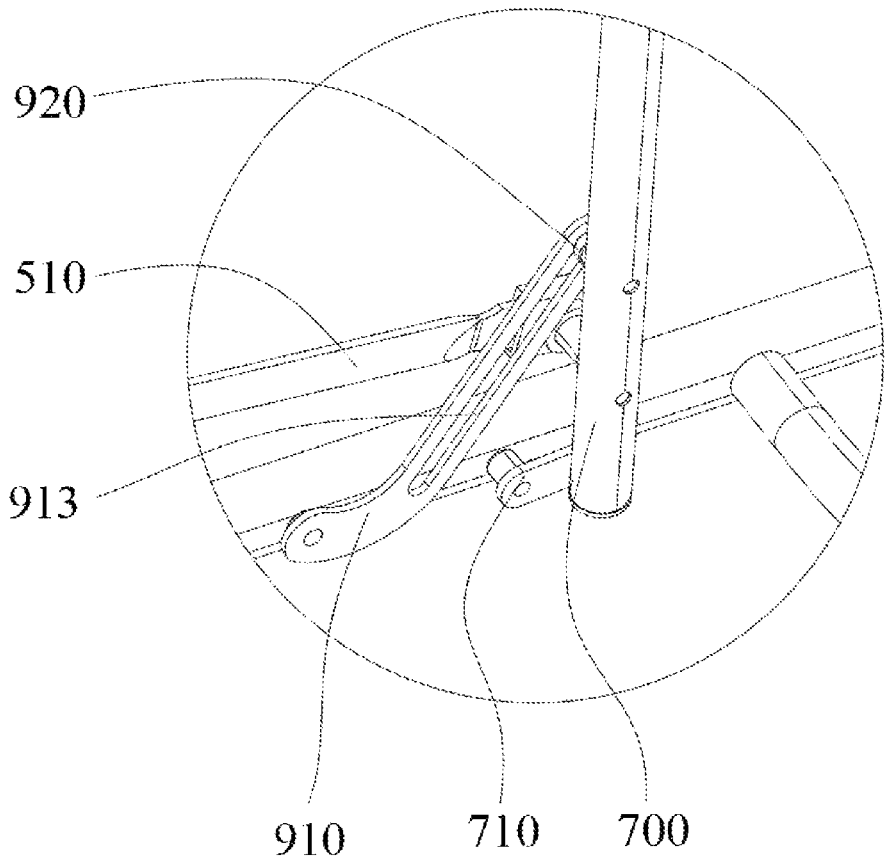
FIG. 12 is an overall mounting structure diagram of the guide mechanism of the present disclosure in the lying state.
Figure 13:
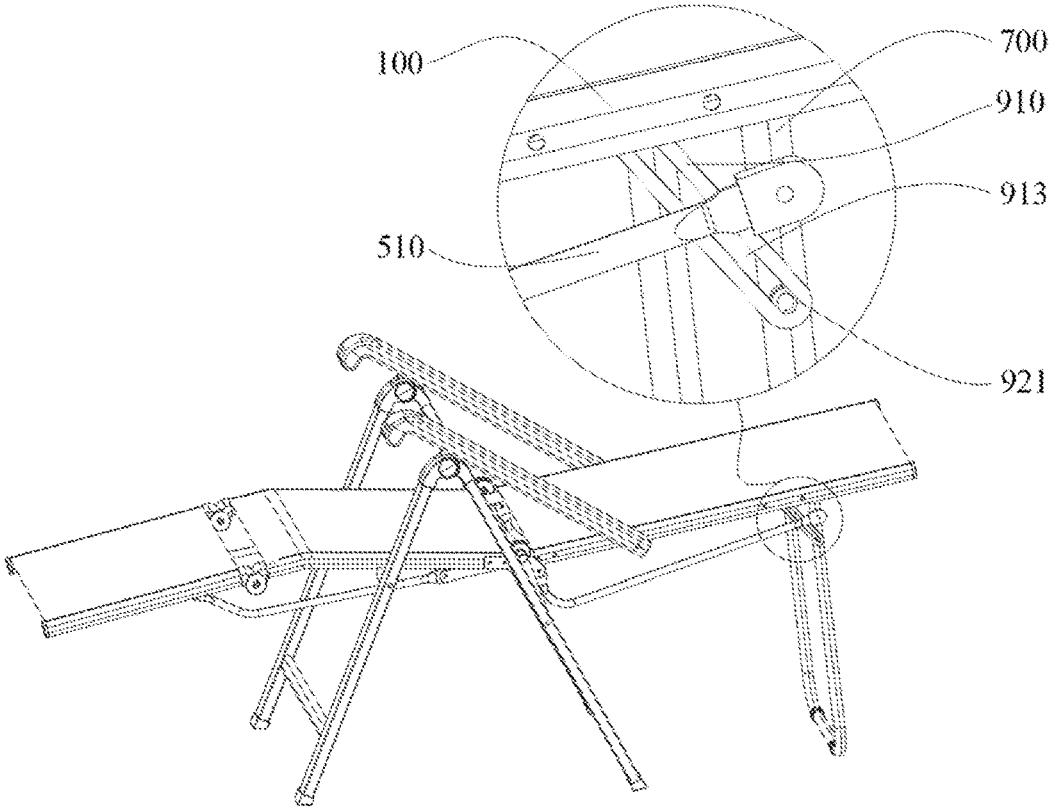
FIG. 13 is a second overall structure diagram of the present disclosure in the lying state.
Figure 14:
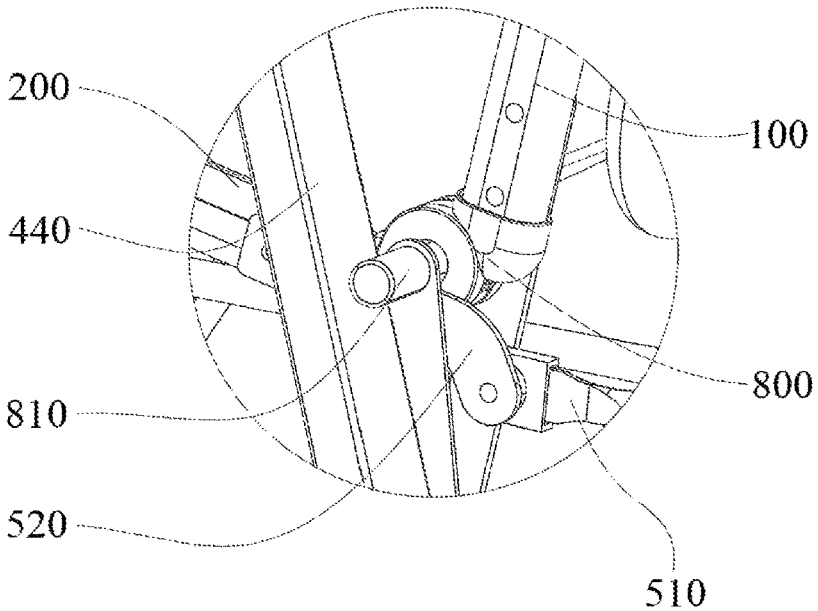
FIG. 14 is a partial mounting structure diagram of the backrest portion and a seat portion of the present disclosure.
Figure 15:
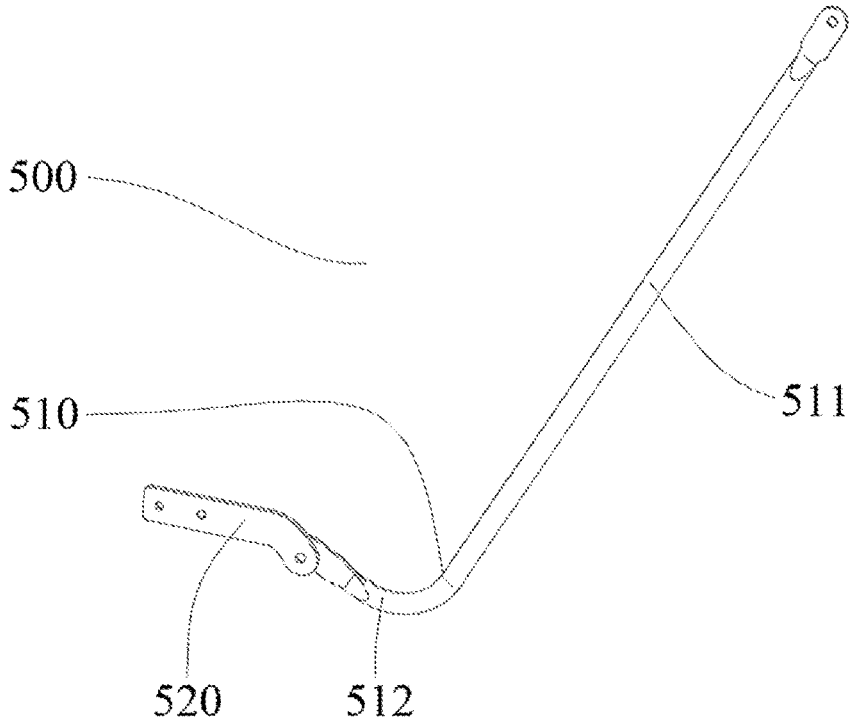
FIG. 15 is a structure diagram of a linkage retraction and supporting mechanism of the present disclosure.
Figure 16:
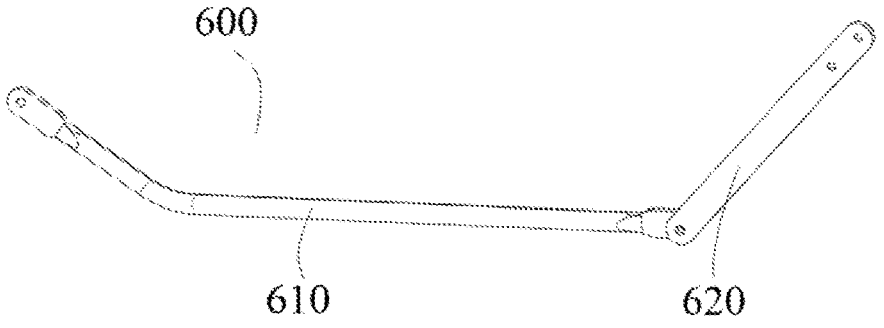
FIG. 16 is a structure diagram of a supporting and folding mechanism of the present disclosure.
Figure 17:
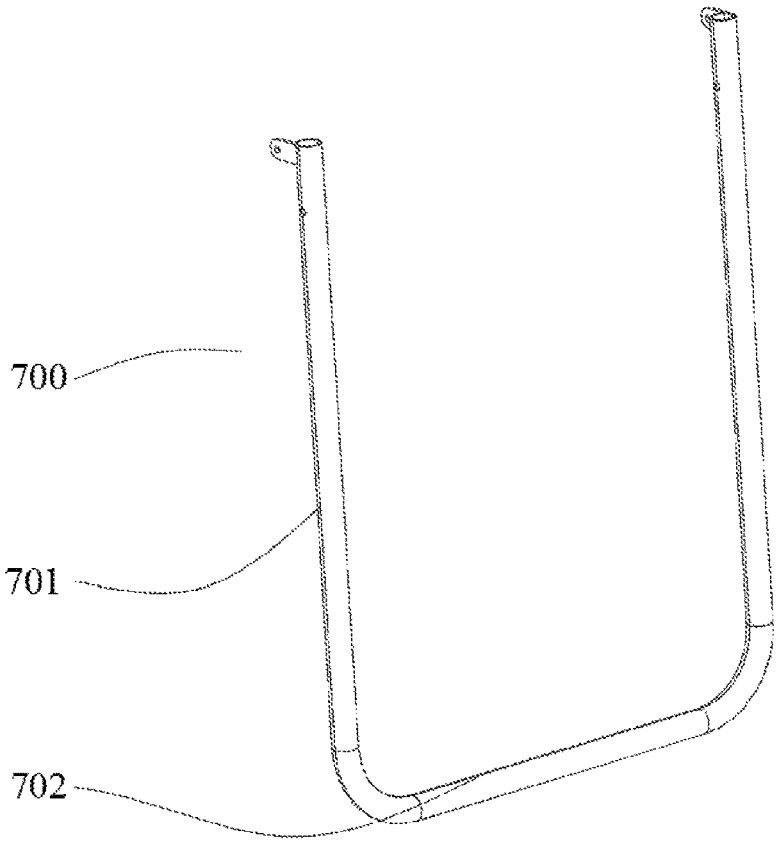
FIG. 17 is a first structure diagram of the supporting leg of the present disclosure.
Figure 18:
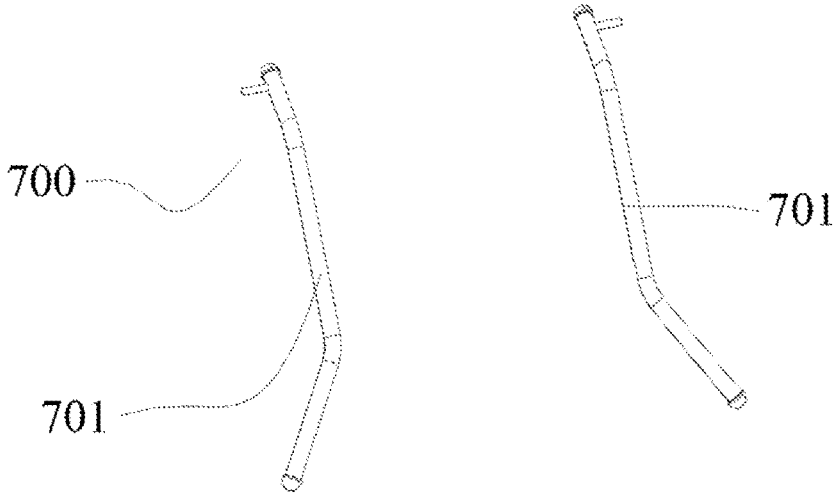
FIG. 18 is a second structure diagram of the supporting leg of the present disclosure.

As shown in FIG. 1-FIG. 18, the present disclosure discloses a folding recliner with guide mechanisms, including a backrest portion 100, a seat portion 200 and a footrest portion 300, where hinge bases 800 are arranged between the backrest portion 100 and the seat portion 200, the backrest portion 100 is movable relative to the seat portion 200 by means of the hinge bases 800, and an upper end of the footrest portion 300 is configured to be hinged and fitted with the seat portion 200. The folding recliner is preferably provided with three portion structures, which can facilitate sitting, leg supporting and back supporting of a user, thereby achieving the good sitting experience; and when the folding recliner is laid flat, a lying state can be formed conveniently, and thus the user can lie conveniently for resting.

In the specific structure, a supporting leg 700 is arranged at the back of the backrest portion 100, the supporting leg 700 is configured to support the backrest portion 100, and when the folding recliner is laid flat, the backrest portion 100 makes contact with the ground for supporting by means of the supporting leg 700, such that the user can be stabler when lying for resting; linkage retraction and supporting mechanisms 500 are fitted with the supporting leg 700, and the linkage retraction and supporting mechanisms 500 are configured to automatically unfold and support the supporting leg 700, thereby avoiding potential safety hazards caused by the fact that the supporting leg 700 cannot be supported in place when the folding recliner is laid flat.

Each of the linkage retraction and supporting mechanisms 500 includes a retraction and supporting rod 510 and a linkage rod 520, one end of the retraction and supporting rod 510 is configured to be hinged and fitted with the supporting leg 700, an upper portion of the supporting leg 700 is configured to be hinged and fitted with the backrest portion 100, a hinged position of the retraction and supporting rod 510 and the supporting leg 700 is lower than a horizontal plane where hinged positions of the supporting leg 700 and the backrest portion 100 are located, the other end of the retraction and supporting rod 510 is configured to be hinged and fitted with the linkage rod 520, and the other end of the linkage rod 520 is fixedly mounted on the seat portion 200; when the backrest portion 100 is changed from a vertical state to a lying state, the supporting leg 700 is supported by the retraction and supporting rods 510, an angle between the supporting leg 700 and the backrest portion 100 is gradually increased, and when the bottom of the supporting leg 700 abuts against the ground, the supporting leg 700 and the backrest portion 100 are in the maximum opening and closing angle; and when the backrest portion 100 is changed from the lying state to the vertical state, the supporting leg 700 is pulled by the retraction and supporting rods 510, and the angle between the supporting leg 700 and the backrest portion 100 is gradually reduced. In the above structure, by means of the turning movement of the backrest portion 100, with the movement of the backrest portion 100, the retraction and supporting rods 510 are limited by hinged positions of the linkage rods 520, such that the other ends of the retraction and supporting rods 510 continue to limit the position of the supporting leg 700, the supporting leg 700 is limited by hinged positions at two ends and is limited by the hinged positions of the supporting leg 700 and the backrest portion 100 and the hinged positions of the supporting leg 700 and the retraction and supporting rods 510, with the lying of the backrest portion 100, the retraction and supporting rods 510 are laid and moved synchronously, by means of the synchronous limiting of two hinge point positions, the supporting leg 700 can only continue to rotate until it abuts against the ground to complete automatic opening and supporting of the supporting leg 700.

In the preferred structure, the guide mechanisms 900 are additionally arranged; each of the guide mechanisms 900 includes a guide rod 910 and a guide member 920, one end of the guide rod 910 is configured to be hinged and fitted with the backrest portion 100, the other end of the guide rod is a free end, the other end of the guide rod 910 can swing, a guide sliding groove 913 is formed in the guide rod 910, the guide member 920 is capable of moving along the guide sliding groove 913, and one end of the guide member 920 is mounted on the supporting leg 700 in a fitted manner; when the backrest portion 100 is changed from the vertical state to the lying state, the supporting leg 700 is supported by the retraction and supporting rods 510, the supporting leg 700 moves along the guide sliding grooves 913 by means of the guide members 920, and the angle between the supporting leg and the backrest portion 100 is gradually increased; and when the backrest portion 100 is changed from the lying state to the vertical state, the supporting leg 700 is pulled by the retraction and supporting rods 510, the supporting leg 700 moves along the guide sliding grooves 913 by means of the guide members 920, and the angle between the supporting leg 700 and the backrest portion 100 is gradually reduced. The guide mechanisms 900 are added and are combined with the linkage retraction and supporting mechanisms 500, with the unfolding and lying of the folding recliner and the deflection of the backrest portion 100, the supporting leg 700 is driven by the retraction and supporting rods 510, in combination with the movement of the supporting leg 700 along the guide sliding grooves 913 by means of the guide members 920, the supporting leg 700 can be unfolded and supported along a fixed trajectory, and thus the supporting and unfolding stability and reliability of the supporting leg 700 can be improved.

In the specific structure, the hinged position of the supporting leg 700 with the backrest portion 100 is located above the hinged positions of the guide rods 910 with the backrest portion 100, and the hinged positions of the retraction and supporting rods 510 with the supporting leg 700 are located above mounting positions of the guide members 920 on the supporting leg 700, thereby facilitating linkage fitting of various components.

In the preferred structure, each of the guide members 920 includes a guide shaft body, one end of the guide shaft body is fixedly mounted on the supporting leg 700, the other end of the guide shaft body extends outwards and penetrates through the respective guide sliding groove 913, and the guide shaft body is capable of reciprocating along the guide sliding groove 913 under the drive of the supporting leg 700; each of the guide sliding grooves 913 has a starting end and a tail end, the starting end is located at an upper portion, when the respective guide shaft body is located at the starting end, the backrest portion 100 is in the vertical state, and the supporting leg 700 is vertically suspended and hung at the back of the backrest portion 100; and when the guide shaft body moves to the tail end under the drive of the supporting leg 700, the backrest portion 100 is in the lying state, and the bottom end of the supporting leg 700 abuts against the ground. The structure of the guide sliding grooves 913 is designed in an optimized manner, such that the unfolding and supporting trajectory of the supporting leg 700 is stabler and more effective.

In the specific structure design, each of the guide rods 910 includes a bent rod portion 912 and a straight rod portion 911, the respective guide sliding groove 913 is located on the straight rod portion 911, a guide rod abutting hole 914 is formed in an end portion of the bent rod portion 912, guide rod hinge holes 102 are formed in the backrest portion 100, and the guide rod abutting hole 914 and the respective guide rod hinge hole 102 are mounted in a fitted manner by means of a third hinge shaft 930, thereby facilitating assembling and mounting of the guide rod 910.

In one of the preferred embodiments, each of the guide sliding grooves 913 is a long hole groove, and the long hole groove is of a runway hole structure; and in other embodiments, each of the guide sliding grooves 913 may also be of a track structure, and the respective guide member 920 can be a sliding block component fitted with a track.

In one of the preferred embodiments, a guide wheel 921 is arranged on each of the guide shaft bodies, and the guide wheel 921 is configured to be in sliding fit along the respective guide sliding groove 913, thereby increasing the sliding stability and smoothness, and improving the supporting and closing convenience and smoothness of the supporting leg 700.

In the specific structure design, hinge lifting lugs 710 are arranged at upper ends of the supporting leg 700, supporting abutting holes 711 are formed in the hinge lifting lugs 710, supporting hinge holes 101 are formed in the backrest portion 100, and the supporting abutting holes 711 and the supporting hinge holes 101 are mounted in a fitted manner by means of first hinge shafts 720; and retraction and supporting hinge holes 730 are formed in the supporting leg 700, retraction and supporting abutting holes 501 are formed in end portions of the retraction and supporting rods 510, and the retraction and supporting abutting holes 501 and the retraction and supporting hinge holes 730 are mounted in a fitted manner by means of second hinge shafts 530, thereby facilitating hinged and fitted mounting of the various components.

In combination with the above, each of the retraction and supporting rods 510 includes a retraction and supporting straight rod portion 511 and a retraction and supporting bent rod portion 512, an end portion of the retraction and supporting straight rod portion 511 is configured to be hinged and fitted with the supporting leg 700, and an end portion of the retraction and supporting bent rod portion 512 is configured to be hinged and fitted with the respective linkage rod 520; the retraction and supporting bent rod portions 512 are designed in an optimized manner, by means of a bent pipe structure, the good transmission transition can be achieved, the good linkage retraction and supporting effect can be formed, and the supporting leg 700 can be conveniently driven to be retracted or automatically opened.

In combination with the above, the supporting leg 700 includes supporting leg bodies 701 located on two sides, the hinge lifting lugs 710 are arranged at upper ends of the supporting leg bodies 701, the hinge lifting lugs 710 are hinged and fitted with the backrest portion 100 by means of the first hinge shafts 720, and the end portions of the retraction and supporting straight rod portions 511 are hinged and fitted with the supporting leg bodies 701 by means of the second hinge shafts 530. In one of the preferred embodiments, the bottoms of the supporting leg bodies 701 on the two sides are connected to supporting leg rods 702, the supporting leg 700 is "U"-shaped as a whole, the supporting leg structure can be fitted with the retraction and supporting rod on the single side to achieve automatic supporting and retraction.

In other embodiments, the supporting leg bodies 701 may be independent components, and the supporting leg body 701 on any side is configured to be mounted on the retraction and supporting rod 510 on the same side in a fitted manner.

In combination with the above, the hinge bases 800 are arranged between the backrest portion 100 and the seat portion 200, a limiting shaft 810 is further arranged on each of the hinge bases 800, and the limiting shaft 810 extends outwards and is configured to abut against and be fitted with a wall of a rear side leg pipe 440; side chair leg pipe portions 400 are further included; each of the side chair leg pipe portions 400 includes a front side leg pipe 430, the rear side leg pipe 440 and an armrest pipe 410, an upper end of the front side leg pipe 430 and an upper end of the rear side leg pipe 440 are mounted in a fitted manner by means of a hinge mounting base 430, an upper portion of the hinge mounting base 430 is configured to be mounted on the armrest pipe 410 in a fitted manner, and a rear end of the armrest pipe 410 is configured to be hinged and fitted with the backrest portion 100. The hinge bases 800 are optimized, thereby facilitating the hinged movement of the backrest portion 100 and the seat portion 200; and meanwhile, the limiting shafts 810 are preferably arranged, and the limiting shafts 810 abut against and are fitted with the rear side leg pipes 440 and are configured to improve the folding and lying stability of the folding recliner.

Preferably, supporting and folding mechanisms 600 are further arranged between the footrest portion 300 and the backrest portion 100; when the backrest portion 100 leans back and is gradually laid flat, the supporting and folding mechanisms 600 are configured to support the footrest portion 300 to be deflected outwards and upwards; each of the supporting and folding mechanisms 600 includes a supporting and folding rod 610 and a connection rod 620, one end of the supporting and folding rod 610 is configured to be hinged and fitted with the footrest portion 300, the other end of the supporting and folding rod is configured to be hinged and fitted with the connection rod 620, and the other end of the connection rod 620 is configured to be fixedly mounted on the backrest portion 100. The supporting and folding mechanisms 600 are designed in an optimized manner, under the action of the supporting and folding rods 610, the footrest portion 300 can be synchronously linked with the backrest portion 100, thereby facilitating lying of the folding recliner.

According to the present disclosure, the guide mechanisms are optimized and added, such that the supporting leg can form guide supporting after the folding recliner is laid flat, and the supporting and unfolding stability and reliability of the supporting leg can be improved; moreover, under the drive of the retraction and supporting rods, and in combination with guide movements of the guide mechanisms, the automatic landing support of the supporting leg can be enhanced, and the use convenience and safety can be improved.

The above description is only the preferred embodiments of the present disclosure, and is not intended to limit the present disclosure in any way. Any simple amendment, equivalent change, or modification made to the above embodiments in accordance with the technical principles of the present disclosure still falls within the scope of the technical solution of the present disclosure.

What is claimed is:

1. A folding recliner with guide mechanisms, comprising a backrest portion, a seat portion, and a footrest portion, wherein a supporting leg is arranged at a back of the backrest portion; retraction and supporting rods are fitted with the supporting leg, one end of each of the retraction and supporting rods is configured to be hinged and fitted with a linkage rod, and one end of the linkage rod is mounted on the seat portion in a fitted manner; guide mechanisms, wherein each of the guide mechanisms comprises a guide rod and a guide member, one end of the guide rod is configured to be hinged and fitted with the backrest portion, another end of the guide rod is a free end, a guide sliding groove is formed in the guide rod, the guide member is capable of moving along the guide sliding groove, and one end of the guide member is mounted on the supporting leg in a fitted manner; when the backrest portion is changed from a vertical state to a lying state, the supporting leg is supported by the retraction and supporting rods, the supporting leg moves along the guide sliding groove by means of the guide member, and an angle between the supporting leg and the backrest portion is gradually increased; and when the backrest portion is changed from the lying state to the vertical state, the supporting leg is pulled by the retraction and supporting rods, the supporting leg moves along the guide sliding groove by means of the guide member, and the angle between the supporting leg and the backrest portion is gradually reduced.

2. The folding recliner with the guide mechanisms according to claim 1, wherein a hinged position of the supporting leg with the backrest portion is located above a hinged position of the guide rod with the backrest portion.

3. The folding recliner with the guide mechanisms according to claim 2, wherein hinged positions of the retraction and supporting rods with the supporting leg are located above a mounting position of the guide member on the supporting leg.

4. The folding recliner with the guide mechanisms according to claim 3, wherein the guide member comprises a guide shaft body, one end of the guide shaft body is fixedly mounted on the supporting leg, another end of the guide shaft body extends outwards and penetrates through the guide sliding groove, and the guide shaft body is driven by the supporting leg to be capable of reciprocating along the guide sliding groove.

5. The folding recliner with the guide mechanisms according to claim 4, wherein the guide sliding groove has a starting end and a tail end, when the guide shaft body is located at the starting end, the backrest portion is in the vertical state, and the supporting leg is vertically suspended and hung at the back of the backrest portion; and when the guide shaft body is driven by the supporting leg to move to the tail end, the backrest portion is in the lying state, and a bottom end of the supporting leg abuts against a ground.

6. The folding recliner with the guide mechanisms according to claim 5, wherein the guide rod comprises a bent rod portion and a straight rod portion, the guide sliding groove is located on the straight rod portion, a guide rod abutting hole is formed in an end portion of the bent rod portion, guide rod hinge holes are formed in the backrest portion, and the guide rod abutting hole and the guide rod hinge hole are mounted in a fitted manner by means of a third hinge shaft.

7. The folding recliner with the guide mechanisms according to claim 6, wherein the guide sliding groove is a long hole groove.

8. The folding recliner with the guide mechanisms according to claim 7, wherein a guide wheel is arranged on the guide shaft body, and the guide wheel is configured to be in sliding fit along the guide sliding groove.

9. The folding recliner with the guide mechanisms according to claim 1, wherein hinge lifting lugs are arranged at upper ends of the supporting leg, supporting abutting holes are formed in the hinge lifting lugs, supporting hinge holes are formed in the backrest portion, and the supporting abutting holes and the supporting hinge holes are mounted in a fitted manner by means of first hinge shafts.

10. The folding recliner with the guide mechanisms according to claim 9, wherein retraction and supporting hinge holes are formed in the supporting leg, retraction and supporting abutting holes are formed in end portions of the retraction and supporting rods, and the retraction and supporting abutting holes and the retraction and supporting hinge holes are mounted in a fitted manner by means of second hinge shafts.

* * * * *